United States Patent [19]

DeCaro

[11] 4,295,394

[45] Oct. 20, 1981

[54] INSTALLATION TOOL BARREL ASSEMBLY

[75] Inventor: Charles J. DeCaro, Pittsburgh, Pa.

[73] Assignee: Textron Inc., Providence, R.I.

[21] Appl. No.: 124,524

[22] Filed: Feb. 25, 1980

[51] Int. Cl.[3] ..... B25B 23/02

[52] U.S. Cl. ..... 81/57.37; 81/451

[58] Field of Search ..... 81/57.37, 431, 432, 81/433, 434, 435, 451, 452, 453, 454, 455, 456, 462, 57.24, 57.4, 457, 458

[56] References Cited

U.S. PATENT DOCUMENTS

| | | | |
|---|---|---|---|
| 1,945,741 | 2/1934 | Gray | 81/451 |
| 2,327,074 | 8/1943 | Snyder | 81/57.37 |
| 3,656,520 | 4/1972 | Caffa | 81/57.37 |
| 3,973,605 | 8/1976 | DeCaro | 81/57.37 |

*Primary Examiner*—James L. Jones, Jr.

[57] ABSTRACT

The installation tool barrel assembly includes an outer sleeve adapted for connection to the driving tool, an inner sleeve retractably attached within the outer sleeve and a barrel retractably attached to the inner sleeve. A fastener entrant comprises an elongated slot in the inner sleeve wall which increases in depth along its length from a starting point and terminates in an enlarged clear through opening in registry with the inner sleeve bore. The barrel includes a clear through notch in alignment with the slot to receive the fastener in the bore of the barrel. A workpiece pad is positioned at the end of the barrel and includes a jaw assembly having spring bias jaws mounted for slidable engagement on a wear plate. A footpad is provided for holding the workpiece pad against the workpiece during installation.

8 Claims, 13 Drawing Figures

INSTALLATION TOOL BARREL ASSEMBLY

BACKGROUND OF THE INVENTION

My invention relates to installation tools and, more particularly, to installation tools having barrel assemblies which can be loaded by a fastener fed through an opening in the barrel.

Many driving tools have been developed for driving fasteners into workpieces. The intended use of the driving tools often defines problems which require unique solutions. One such application requiring special driving tools is the installation of insulation on metal roof deck. The insulation is normally held to the roof deck by means of enlarged washer-like plates through which an elongated threadable fastener or nail type fastener extends. The insulation may be six inches thick or more and, therefore, the fastener which often approaches seven or eight inches must be held in proper alignment so that it properly penetrates the insulation and the metal roof deck.

The above type of application requires the loading of an elongated fastener into the tool and a proper alignment of the fastener within the tool.

A number of fastener entrant means have been proposed heretofore. In my United States Pat. No. 3,973,605 I disclose a breech-type barrel assembly which opens in the manner of a shotgun to receive a hand fed fastener. In my United States Pat. No. 4,081,254 I disclose a barrel assembly in which a strip carrying fasteners passes through slots in the wall of the barrel to sequentially place the fasteners within the barrel bore. Others have heretofore provided entrant means in barrel assemblies wherein the fastener is hand fed through appropriate slots in the barrel wall into the barrel bore. Exemplary of these patents are U.S. Pat. Nos. 2,845,968, 2,484,655 and Netherlands Pat. No. 51,874.

A number of power operated screwdrivers include automatic means of feeding fasteners. Exemplary of these are U.S. Pat. Nos. 3,907,014, 3,524,484, 2,922,447 and 2,327,074. Several of the above patents also teach various jaw assemblies for holding the fastener in alignment at the time of installation. Other patents teaching means for holding the fastener within the barrel at the time of installation include U.S. Pat. Nos. 3,056,441, 1,889,330 and 3,226,537.

For the most part, the various tools disclosed in the above patents are not suitable for handling extremely long fasteners in which alignment is also critical. A commonly used tool for installing insulation on roof deck includes a tube feed. However, the incidence of bowed fasteners increases with fastener length and this in turn causes jamming within the tube feed. In addition, the barrel must be extremely long to accommodate a fastener fed at an angle to the barrel. Because of the required length of the barrel assemblies, the overall weight is increased. In addition, the tool becomes cumbersome and wear problems and alignment problems increase.

SUMMARY OF THE INVENTION

I have now improved upon the concepts disclosed in the above-identified patents and have developed a barrel assembly particularly applicable to the handling of long fasteners in which alignment of the fastener and wear and tear on the equipment have heretofore been a problem.

Specifically, I have developed a barrel assembly for an installation tool primarily intended for the installation of long fasteners through insulation and into roof deck. The barrel assembly includes an entrant means in which an elongated slot in the barrel wall increases in depth along its length from a starting point and terminates in an enlarged clear through opening in registry with the bore. A retractable barrel cooperates with the inner sleeve and includes a clear through notch in registry with the elongated slot to receive the fastener in the barrel bore. A jaw assembly is included in a workpiece pad connected at the end of the barrel. Spring loaded jaws slidably engage a wear plate which receives a major portion of the thrust of the installation tool during use. A foot pad or other holding means may be provided to assist in holding the installation tool firmly against the workpiece.

DESCRIPTION OF THE PREFERRED EMBODIMENTS

Figure 1:
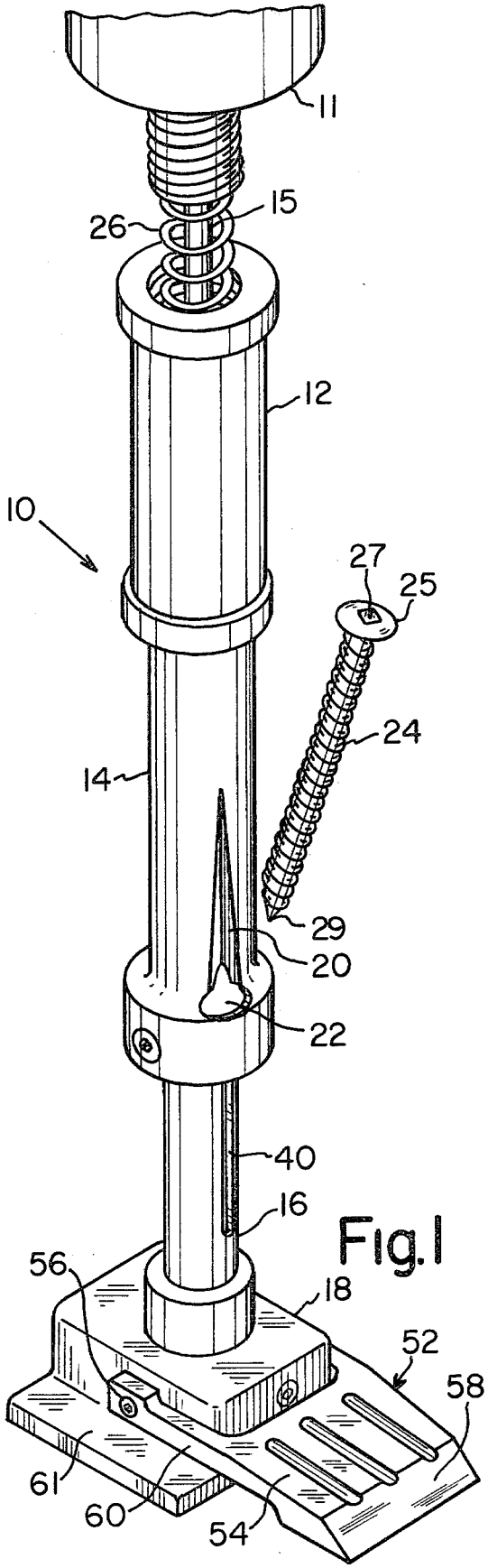
FIG. 1 is a perspective view of my barrel assembly attached to a driving tool partly shown.

My barrel assembly, generally designated 10, is adapted for attachment to a standard driving tool 11 of the type used to drive fasteners 24 into a workpiece (not shown), FIG. 1.

Figure 2:
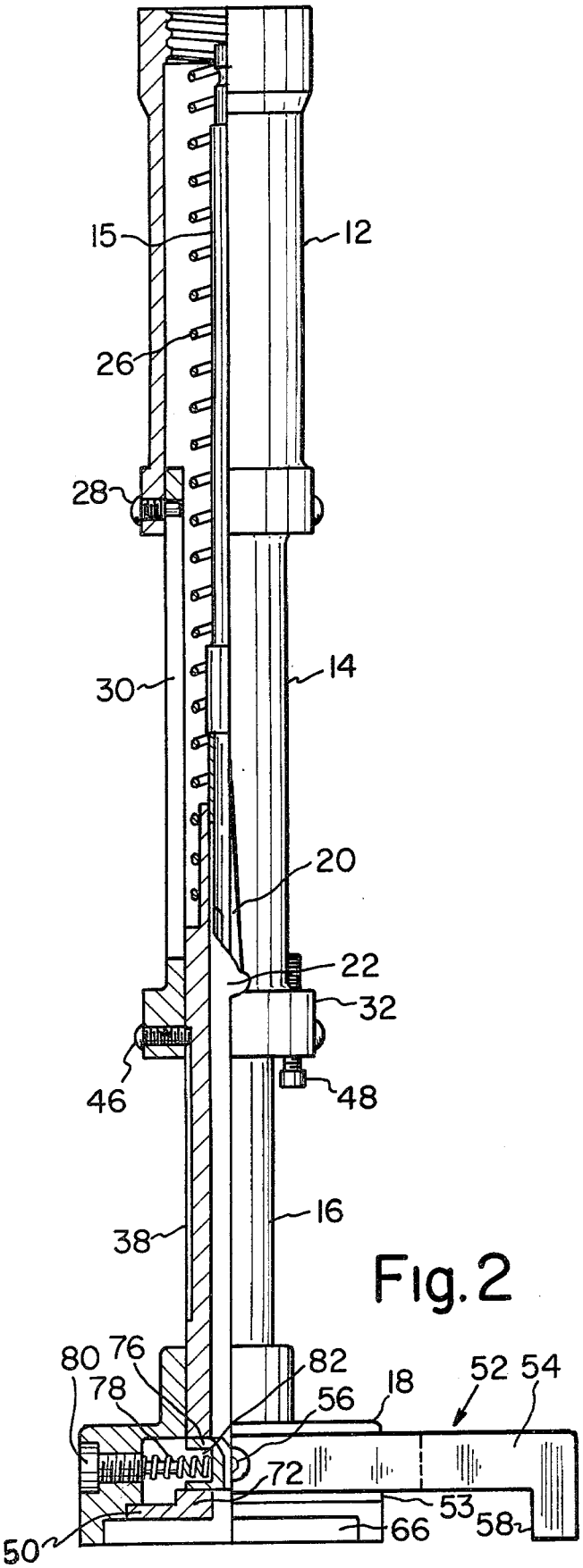
FIG. 2 is a side elevation in which one-half of the barrel assembly along the longitudinal center line is in section.

My barrel assembly 10 includes an outer sleeve 12 adapted for connection to the driving tool, FIGS. 1 and 2. An inner sleeve 14 attaches to and is retractable into the outer sleeve 12. A barrel 16 is retractably connected to the inner sleeve 14, and a workpiece pad 18 having a footrest 52 extending outward therefrom is connected at the distal end of the barrel 16. The retractable barrel 16 and retractable inner sleeve 14 are biased in an extended position by means of a coil spring 26 which engages the driving tool at one end and the barrel 16 at the other end. The axial extent of the inner sleeve 14 in the barrel 16 in an extended position is controlled by an adjusting pin 48 extending upward through the flange 32 of the inner sleeve 14. A driver 15 having an appropriate fastener engaging end section, e.g., a screwdriver, extends along a portion of the barrel assembly 10 in an extended position.

Figure 5:
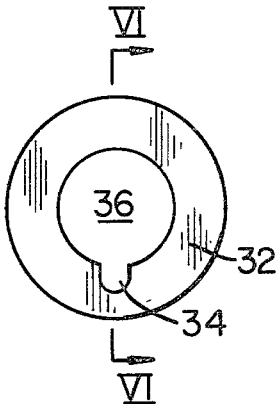
FIG. 5 is an end view of the inner sleeve.
Figure 6:
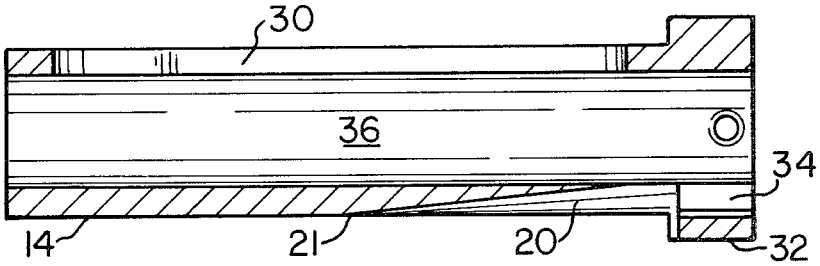
FIG. 6 is a section taken along section lines VI—VI of FIG. 5.
Figure 4:
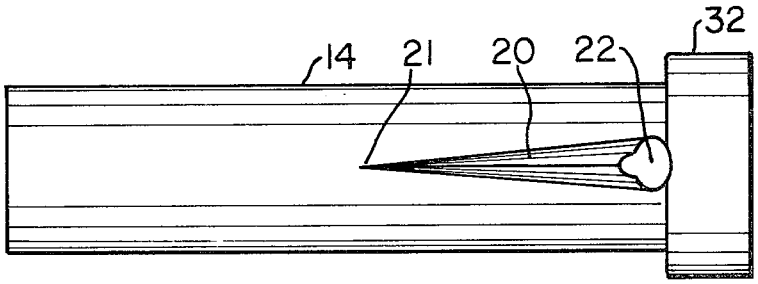
FIG. 4 is an elevation of the inner sleeve.

The inner sleeve 14 which is retractable within the outer sleeve 12 includes an elongated slit 30 which slidably accommodates a threaded pin 28 extending through the outer sleeve 12 near an end thereof to control the axial movement of the inner sleeve 14, FIGS. 2 and 6. The inner sleeve 14 contains a central bore 36 extending the length thereof, FIGS. 4–6. A slot 20 which has a starting point 21 substantially midway of the length of inner sleeve 14 extends longitudinally toward flange 32. Slot 20 which forms the entrant means for the fastener increases in depth from the starting point 21 to its terminal end where it terminates in a clear through opening 22 which communicates with the central bore 36. The slot 20 likewise increases in width from its starting point 21 to the clear through opening 22. A blind groove 34 extends from the clear through opening 22 longitudinally through the interior of the end flange 32, although a clear through groove could also be employed.

Figure 7:
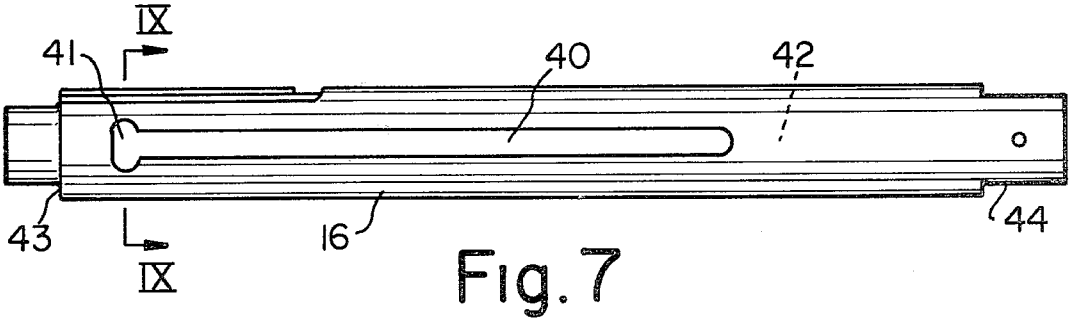
FIG. 7 is a elevation of the barrel showing the clear through slot.
Figure 8:
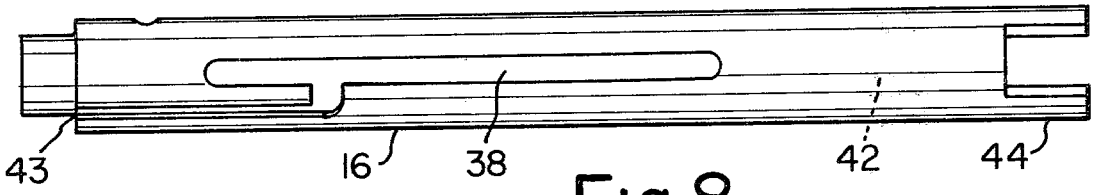
FIG. 8 is an elevation of the barrel showing the bayonet slot.
Figure 9:
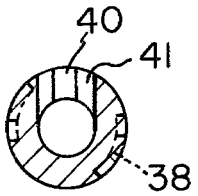
FIG. 9 is a section taken along section lines IX—IX of FIG. 7.

The barrel 16 has a central bore 42 extending the longitudinal length thereof, FIGS. 7–9. The barrel 16 terminates at one end in a pair of axial flanges 44 and at the other end in a reduced section forming a shoulder 43 which shoulder accommodates one end of the spring 26, FIG. 2. The barrel 16 includes a blind bayonet slot 38 for rapid assembly with the inner sleeve 14. Threaded pin 46 extends radially inward through flange 32 of inner sleeve 14 to engage the bayonet slot 38 in slidable relationship and maintain the longitudinal retractable movement of the barrel 16 within the inner sleeve 14. The barrel 16 also includes an elongated clear through notch 40 which is in registry with the barrel bore 42. Notch 40 includes an enlarged area 41 at its upper end to accommodate the fastener head. In the assembled position, notch 40 and enlarged area 41 are in alignment with opening 22 and groove 34 of the inner sleeve 14. Notch 40 terminates well short of the barrel end so that the fastener is fully surrounded by solid wall as it travels to the bottom of the barrel.

Figure 3:
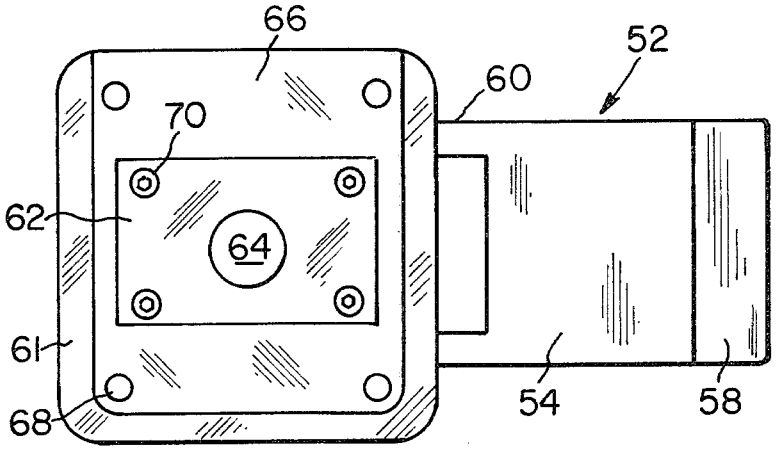
FIG. 3 is a bottom view of the barrel assembly of FIG. 2.

Connected at the terminal end of the barrel 16 is the workpiece pad 18, FIGS. 1–3. Pad 18 houses a pair of spring loaded jaws 76 mounted on a wear plate 50 for aligning the fastener and a footpad 52 for maintaining the pad 18 against the workpiece (not shown), FIGS. 1 and 2.

Figure 10:
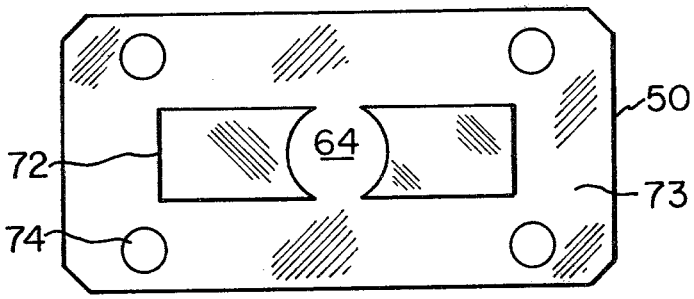
FIG. 10 is a plan view of the wear plate.
Figure 11:
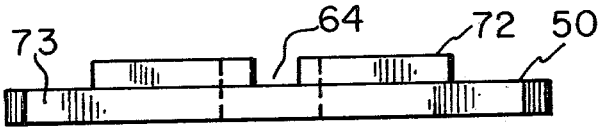
FIG. 11 is a side elevation of the wear plate.

Specifically, the wear plate 50 includes a main plate 73 and a raised platform 72 spaced inward of the periphery of main plate 73, FIGS. 10 and 11. Four spaced holes 74 extend through the main plate 73 adjacent the corners thereof for attachment to the pad 18, and a clear through bore 64 communicates with the bore 42 of the barrel to permit the fastener to pass therethrough. The longitudinal flanges 44 of the barrel 16 extend on either side of the raised platform 72 to prevent rotation of the pad 18 with respect of the barrel 16.

Figure 12:
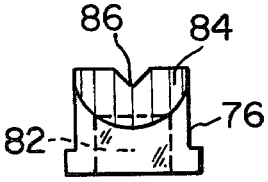
FIG. 12 is a front elevation view of a jaw.
Figure 13:
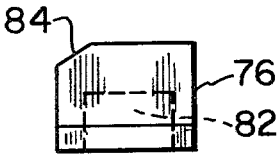
FIG. 13 is a side elevation of the jaw.

Two jaws 76 slidably ride on the platform 72 which bears the brunt of the load of the driver tool 11 and barrel assembly 12 during an installation sequence, FIG. 2. Each jaw 76 includes an arcuate beveled entry section 84 having a notch 86 at the center thereof, FIGS. 12 and 13. The jaws 76 also include a recess 82 which accommodates a jaw spring 78, FIG. 2. The jaws 76 are urged against one another by means of jaw springs 78 positioned within the recesses 84 through fasteners 80 extending through the pad 18. In the closed position the notches 86 are aligned to form an entry point for the fastener point 29.

The bottom of pad 18 includes a recess 66 which in the case of insulation installation houses a plate (not shown) through which the fastener passes for holding the insulation to a metal roof deck, FIGS. 2 and 3. Four magnets 68 are positioned in the corners of the recess 66 for holding a metal plate in position during installation. Where plastic plates are employed, alternate holding means are provided. The bearing plate 62 is connected to the pad 18 by means of fasteners 70 extending through the holes 74 of plate 73 into the pad 18.

Extending from end 53 of the workpiece pad 18 is a footpad 52, FIGS. 1 and 2. Footpad 52 comprises beam 54 which splits at one end into arms 60 and which includes a depending leg 58 at the other end for resting on the workpiece. Arms 60 are appropriately apertured to receive pivot pin 56 which extends through pad 18 midway of its ends along the barrel center line. Although two slightly differing shapes are shown for the footpad 52 (FIGS. 1 and 2), the key is the pivotal connection along the barrel center line. As the installer steps on the footpad a downward component of the applied force passes through the axial center of the barrel to achieve maximum hold down and proper alignment.

The installation of a fastener 24 using my barrel assembly 10 as follows. In the extended position the driver 15 is above and out of interference with the bore in the area of opening 22 in the inner sleeve 14. The fastener 24 having a head 25 with a screwdriver receiving recess 27 is hand fed into the slot 20 by merely inserting the point 29 into slot 20 and letting it slide therealong into the opening 22. The fastener 24 passes by gravity into the barrel bore through notch 40 and the fastener head falls through the enlarged area 41. The movement of the fastener is slightly interrupted as the fastener head falls in place and the slight angular direction of the fastener becomes coaxial with the barrel bore. The point 29 of the fastener 24 is guided into the aligned notches 86 of the jaws 76 by the beveled surfaces 84.

The pad 18 is then checked for proper position on the workpiece and the operator's foot is positioned on footpad 52. As the operator pushes down on the power tool 11, the sleeve 14 and barrel 16 start to retract and the screwdriver end of the driver 15 is able to engage the slot 27 of the fastener 24. The continued application of force pushes the fastener through the jaws 76 which slidably retract along the raised platform 72 of wear plate 50 as the fastener is driven along the beveled surfaces 84. In this position the barrel 16 has retracted into the inner sleeve 14 which in turn has retracted within the outer sleeve 12. After the fastener 24 is driven, the driver assembly 10 and driver tool 11 are removed and the spring 26 urges the respective sleeves and barrel into the extended position with the driver out of interference with opening 22 and the barrel assembly is ready for another fastener.

The above tool provides many advantages. Since the jaws are integral with the workpiece pad, the pad cannot be removed by the installer, thus assuring better alignment. The barrel assembly is substantially shorter than one which includes a tube feed. Any bowed fastener is immediately detected as it hangs up in the entrant means and it can be easily removed by hand. The downward thrust of the tool is taken up in large measure by the wear plate, thus minimizing the number of components which must be specially treated for wear. And the footpad keeps everything in place during installation to insure proper alignment and positioning.

I claim:

1. A barrel assembly suitable for connection to a fastener driver tool having a tool body and a driver comprising:

A. an outer sleeve adapted for attachment at one end to the tool body;

B. an inner sleeve mounted to the outer sleeve so as to be retractable therein, said inner sleeve including an annular wall, a bore and an elongated slot in the wall, said slot increasing in depth from a starting point and terminating in an enlarged clear through opening in registry with the bore to accommodate a fastener head;

C. a barrel retractably connected at a first end to the inner sleeve and including a clear through notch in alignment with said slot to receive the fastener in a bore of the barrel; and D. biasing means associated with the inner sleeve and barrel to urge them into an extended position, the driver being positioned at the tool body end of the clear through notch in said extended position so that the barrel assembly can receive said fastener.

2. The assembly of claim 1, said slot also increasing in width from the tool body end to the enlarged opening.

3. The assembly of claim 1, wherein said notch includes an enlarged area at one end in registry with said enlarged clear through opening.

4. The assembly of claim 1 including a jaw assembly pad connected to the distal end of the barrel, said jaw assembly pad adapted to receive and guide a fastener out of said barrel assembly while engaging a workpiece.

5. The assembly of claim 4, said jaw assembly comprising at least two jaw springs biased and mounted for slidable engagement on a wear plate.

6. The assembly of claim 4 including means for holding said jaw assembly pad against a workpiece.

7. A barrel assembly suitable for connection to a fastener driver tool having a tool body and a driver comprising:

A. an outer sleeve adapted for attachment at one end to the tool body;

B. an inner sleeve mounted to the outer sleeve so as to be retractable therein, said inner sleeve including an annular wall, a bore and an elongated slot in the wall, said slot increasing in depth from a starting point and terminating in an enlarged clear through opening in registry with the bore to accommodate a fastener head;

C. a barrel retractably connected at a first end to the inner sleeve and including a clear through notch in alignment with said slot to receive the fastener in a bore of the barrel;

D. biasing means associated with the inner sleeve and barrel to urge them into an extended position, the driver being positioned at the tool body end of the clear through notch in said extended position so that the barrel assembly can receive said fastener;

E. a jaw assembly pad connected to a distal end of the barrel, said jaw assembly pad adapted to receive and guide a fastener out of said barrel assembly while engaging a workpiece; and F. a footrest extending outward from said pad for holding the pad against a workpiece, said footrest pivotally connected at one end to the pad and having a member for engagement with the workpiece at an opposite end.

8. A barrel assembly suitable for connection to a fastener driver tool having a tool body and a driver comprising:

A. an outer sleeve adapted for attachment at one end to the tool body;

B. an inner sleeve mounted to the outer sleeve so as to be retractable therein, said inner sleeve including an annular wall, a bore and an elongated slot in the wall, said slot increasing in depth from a starting point and terminating in an enlarged clear through opening in registry with the bore to accommodate a fastener head;

C. a barrel retractably connected at a first end to the inner sleeve and including a clear through notch in alignment with said slot to receive the fastener in a bore of the barrel;

D. biasing means associated with the inner sleeve and barrel to urge them into an extended position, the driver being positioned at the tool body end of the clear through notch in said extended position so that the barrel assembly can receive said fastener; and E. a jaw assembly pad connected to a distal end of the barrel and including at least two jaw springs biased and mounted for slidable engagement on a wear plate, each of said jaws having a beveled and notched fastener engaging surface and a blind recess to accommodate a spring urged against the jaw by means of a fastener extending into the pad and against one end of the spring, said wear plate defining a pair of shoulders for engagment by longitudinally extending flanges of the barrel, whereby said jaw assembly pad adapted to receive and guide a fastener out of said barrel assembly while engaging a workpiece.

* * * * *